US006751998B2

(12) United States Patent
Sundgren et al.

(10) Patent No.: US 6,751,998 B2
(45) Date of Patent: Jun. 22, 2004

(54) METHOD FOR FORMING A THREE DIMENSIONAL OBJECT

(75) Inventors: Anders Sundgren, Sunderbyn (SE); Mats Lindberg, Luleå (SE); Göran Berglund, Gammelstad (SE)

(73) Assignee: Accra Teknik AB, Öjebyn (SE)

( * ) Notice: Subject to any disclaimer, the term of this patent is extended or adjusted under 35 U.S.C. 154(b) by 0 days.

(21) Appl. No.: 10/272,647

(22) Filed: Oct. 16, 2002

(65) Prior Publication Data

US 2003/0037584 A1 Feb. 27, 2003

Related U.S. Application Data

(62) Division of application No. 09/897,770, filed on Jul. 2, 2001, now Pat. No. 6,640,595.

(51) Int. Cl.[7] ..... B21D 11/14
(52) U.S. Cl. ..... 72/342.5; 72/299
(58) Field of Search ..... 72/302, 299, 305, 72/298, 311, 304, 296, 295, 306, 384, 385, 342.5

(56) References Cited

U.S. PATENT DOCUMENTS

| | | | | | |
|---|---|---|---|---|---|
| 1,105,188 | A | | 7/1914 | Dodge | |
| 1,991,567 | A | | 2/1935 | Morgan | |
| 2,229,517 | A | * | 1/1941 | Nighthart | 72/299 |
| 2,297,055 | A | | 9/1942 | Grad | |
| 2,414,549 | A | | 1/1947 | Nowak | |
| 2,535,295 | A | * | 12/1950 | Lafont | 72/404 |
| 3,182,480 | A | * | 5/1965 | De Menichi | 72/299 |
| 3,280,607 | A | * | 10/1966 | Esken | 72/299 |
| 3,400,567 | A | | 9/1968 | Sirantoine | |
| 3,628,369 | A | * | 12/1971 | Williamson | 72/385 |
| 3,678,723 | A | * | 7/1972 | Tenpas | 72/299 |
| 4,580,430 | A | * | 4/1986 | Takeda et al. | 72/299 |
| 4,972,696 | A | * | 11/1990 | Apps et al. | 72/299 |
| 5,022,129 | A | * | 6/1991 | Gentry | 72/384 |
| 5,063,662 | A | * | 11/1991 | Porter et al. | 72/299 |
| 6,185,978 | B1 | | 2/2001 | Sundgren et al. | |

* cited by examiner

*Primary Examiner*—Daniel C. Crane
(74) *Attorney, Agent, or Firm*—Ware, Fressola, Van der Sluys & Adolphson LLP

(57) ABSTRACT

In a method for forming a three-dimensional object and in particular to a method for forming a three-dimensional beam, it is desirable to form three-dimensional beams (5) having complex forms by using an efficient forming process for the beams which may be incorporated into existing high volume production techniques. The apparatus (1, 31) for forming three-dimensional beams (5) comprises a support device and an actuation device. Support members (2, 32, 41, 51, 61) spaced about the longitudinal axis of the support device locally define an opening (4, 35, 43, 53, 63) for supporting a section of the beam (5). The position of adjacent openings (4, 35, 43, 53, 63) relative to one another defines the overall form of the beam (5) and the actuation device defines the position of each opening (4, 35, 43, 53, 63).

5 Claims, 3 Drawing Sheets

METHOD FOR FORMING A THREE DIMENSIONAL OBJECT

CROSS REFERENCE TO RELATED APPLICATION

This application is a divisional of U.S. Ser. No. 09/897,770 filed on Jul. 2, 2001, now U.S. Pat. No. 6,640,595.

BACKGROUND OF THE INVENTION

1. Technical Field

The present invention relates to a method and apparatus for forming a three-dimensional object and in particular to a method and apparatus for forming a beam.

2. Description of the Background Art

Beams are increasingly used as support structures for the coachwork or body structure of automobiles and for use as support members for front and rear bumpers. The inventors of the present invention have disclosed a method and apparatus for curving three-dimensional closed profile beams in a plane parallel to the plane of movement of a forming tool in granted U.S. Pat. No. 6,185,978. As automobile design is continuously evolving, new shapes and forms are required for the beams which provide the support structure for the body of the automobile. Therefore, it is now desirable to form beams having a large variety of shapes and forms over and above beams curved in one plane as disclosed in the prior art. However, it is also desirable to retain the efficiency associated with manufacturing processes which may be incorporated into high volume production techniques.

SUMMARY OF THE INVENTION

It is an object of the present invention to provide an apparatus and method for the forming of three-dimensional objects and in particular beams which are required to have complex forms by using an efficient forming process for the beams which may be incorporated into existing high volume production techniques.

Accordingly, the present invention provides an apparatus for forming three-dimensional objects in particular three-dimensional beams comprising a support means and an actuation means characterized in that the support means has a number of support members spaced about the longitudinal axis of the support means where each individual support member locally defines an opening for supporting a section of the beam and the position of adjacent openings relative to one another defines the overall form of the beam wherein the actuation means defines the position of each opening.

Preferably, the openings define a position and a shape for a section of a beam within a plane substantially perpendicular to the longitudinal axis of the support means.

Ideally, the support members are also movable in a direction parallel to the longitudinal axis of the support means.

Preferably, the support members are independently operable.

Ideally, each support member is provided as a separable tool having two corresponding halves.

Preferably, each half of the tool is provided with its own actuation means.

Ideally, the actuation means includes physical ramps leading into the openings defined by the support members.

Ideally, the actuation means includes at least one axially adjustable shaft.

Preferably, the shaft is telescopic.

In one embodiment, the actuation means provides support frames for receiving the shafts.

Preferably, the support frames define channels which extend longitudinally on at least two opposite side members of each support frame.

Ideally, the shafts are movably mounted about the channels.

Preferably, the support frames are substantially rectangular.

Additionally, the actuation means provides housings for receiving the support frames.

Preferably, the housings are cylindrical.

Ideally, the support frames are rotatably mounted about the cylindrical housings.

Ideally, the actuation means is operated by mechanical, electrical, pneumatic or manual means.

Preferably, the actuation means is remotely operable.

Ideally, the support members are formed for receiving beams having a variety of cross-sectional shapes.

Preferably, the support members are formed for receiving cylindrical and non cylindrical beams.

Ideally, the apparatus includes a quenching means.

Preferably, the quenching means is provided by a water dispenser mounted on or about the apparatus.

Optionally, the entire apparatus may be enclosed in a chamber and gas is dispensed into the chamber to quench the newly formed beam.

Ideally, the apparatus comprises a mounting means for mounting the apparatus on a production facility.

Preferably, the actuation means is remotely operable in response to a control program running on a control unit.

Ideally, the control programme contains information regarding the relative location of a beam and each support member and the desired form of the beam at each point of contact with each support member.

The present invention also provides a method of forming three-dimensional beams characterised in that sections of the beam are formed locally by support members and adjacent support members are positioned relative to one another to define the overall form of the beam.

In one method, the beam is first engaged by the support members and then formed into a desired overall form by adjustment of the individual support members by the actuation means.

In another method, sections of the beam are first biased by ramps into openings located relative to one another and then formed locally by the openings in the support members.

Preferably, the corresponding halves of the tool on either side of the beam are moved towards one another by the actuation means and the beam is biased into the openings by the interaction of corresponding ramps as a result of the movement of the tool halves towards each other.

Preferably, the beam is preformed by any suitable manufacturing process and is preheated to a predetermined temperature for forming.

Ideally, suitable manufacturing processes include roll forming and blow moulding.

Preferably, the forming is carried out at one workstation.

Optionally, when the beam is non-cylindrical, the method of forming the beam includes twisting of the beam about its longitudinal axis.

Ideally, the method of forming the beam includes quenching of the beam after forming has taken place.

BRIEF DESCRIPTION OF THE DRAWINGS

The present invention will now be described with reference to the accompanying drawings which show by way of example only, two embodiments of an apparatus for forming three-dimensional beams in accordance with the invention. In the drawings.

DETAILED DESCRIPTION OF THE INVENTION

Figure 1:
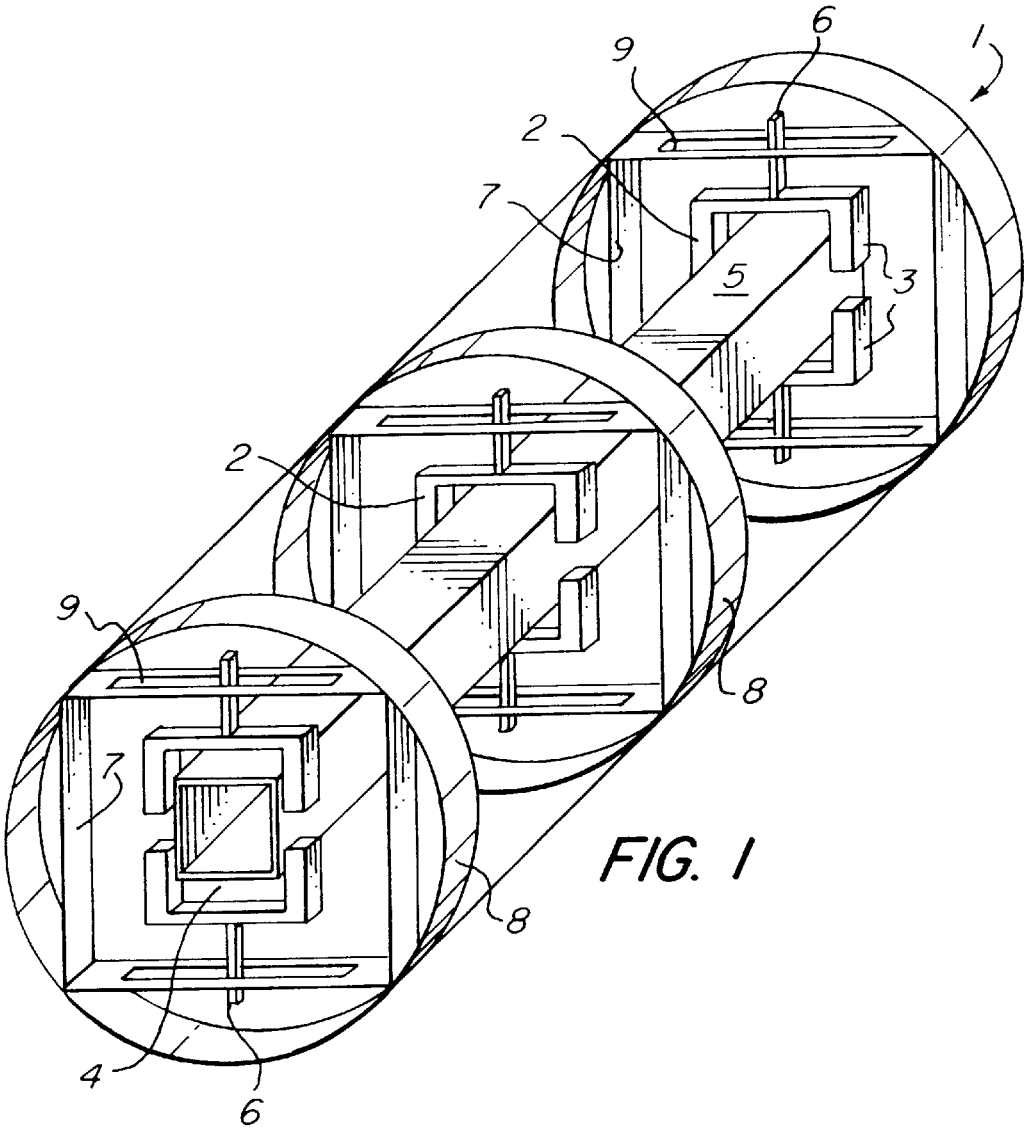
FIG. 1 is a perspective view of a first embodiment of an apparatus for forming three-dimensional beams.
Figure 2:
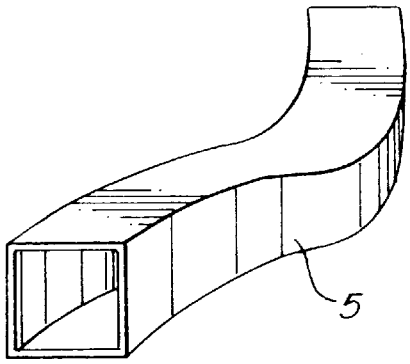
FIG. 2 is a perspective view of a beam formed by the apparatus of FIG. 1.

Referring to the drawings and initially to FIG. 1, there is shown an apparatus indicated generally by the reference numeral 1. Each support member 2 has two corresponding separable tool halves 3 which define openings 4 to support a beam 5. In this specific embodiment, the tool halves 3 and the beam 5 are substantially rectangular. Each of the tool halves 3 has an axially adjustable shaft 6. The shafts 6 are mounted on rectangular frames 7 and are movable along channels 9 which extend longitudinally about opposite side members of the frames 7. The frames 7 are rotatably mounted in cylindrical housings 8. A dispenser (not shown) for flushing the beam 5 with cooling liquid may also be mounted on the apparatus 1. Referring to FIG. 2 there is shown the beam 5 of FIG. 1 after forming has taken place. The beam 5 has been twisted about its longitudinal axis as a result of rotation of one or more of the rectangular frames 7 in one or more of the cylindrical housings 8.

In use, a preheated beam 5 is passed to the apparatus 1 between the tool halves 3 from a conveyor or any standard delivery mechanism used in conjunction with production lines. The beam 5 is then clamped between the halves 3 which are suitably spaced about the longitudinal axis of the apparatus 1 to support the beam 5. The shafts 6 are slidably movable along channels 9 which extend longitudinally on at least two opposite side members of each rectangular frame 7. Axial adjustment of the shafts 6 in combination with slidable movement of the shafts 6 along the channels 9 allows movement for the shafts 6, tool halves 3 and the beam 5 within a plane defined by each rectangular frame 7 and substantially perpendicular to the longitudinal axis of the apparatus 1. The rectangular frames 7 are rotatably mounted in cylindrical housings 8 and the frames 7 may be locked in position in the housing 8 or may be rotated in response to manual, electrical, pneumatic or hydraulic actuation. The rotation of the frames 7 applies a torque to the beam 5 about its longitudinal axis. The cylindrical housings 8 may be fixed in a desired position or may be adjusted in a direction parallel to the longitudinal axis of the apparatus 1.

Figure 3:
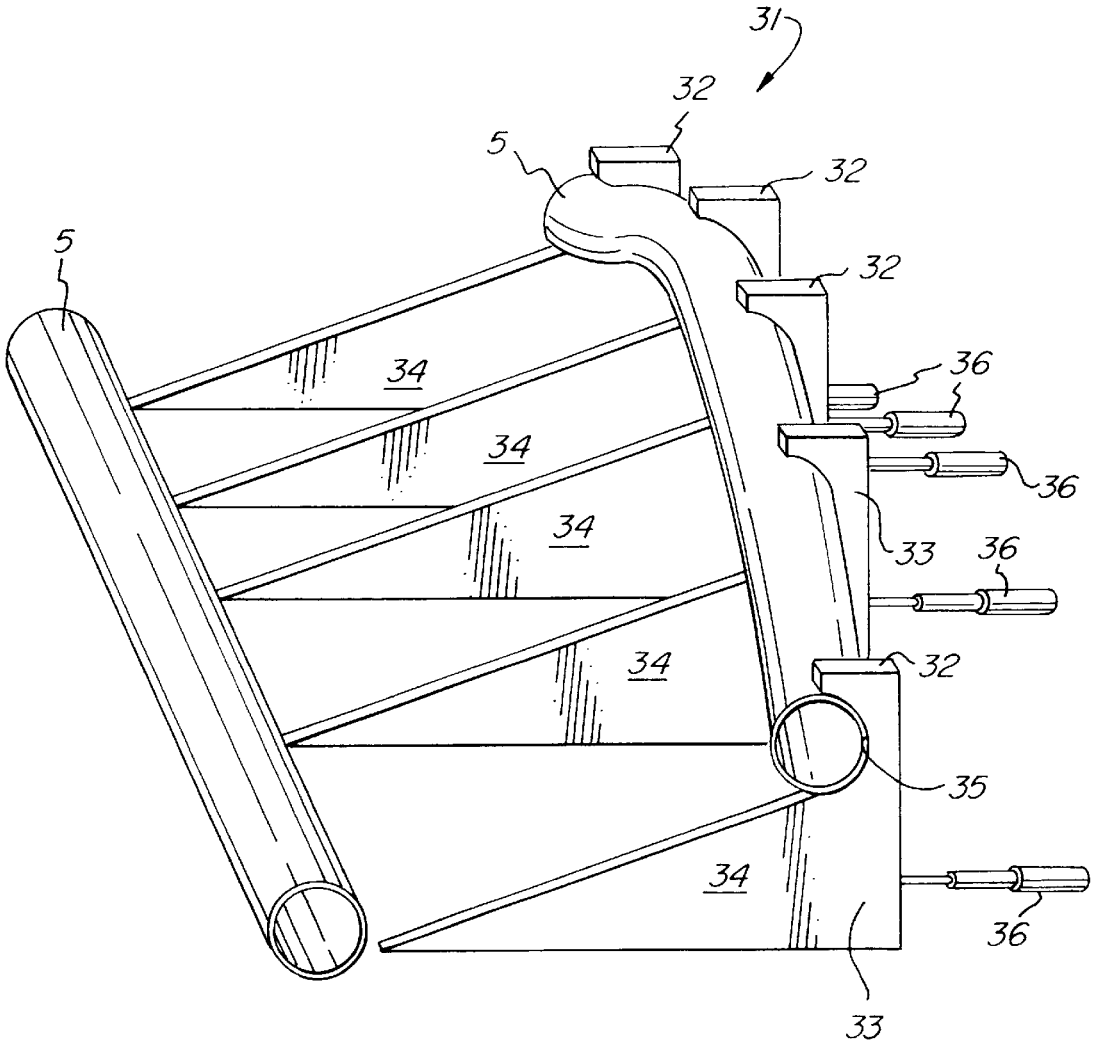
FIG. 3 is a perspective view of a second embodiment of an apparatus in accordance with the invention.

In FIG. 3, a second embodiment of an apparatus for forming three-dimensional beams is indicated generally by the reference numeral 31. Support members 32 are provided as separable tool halves 33, where one half 33 of each support member 32 is shown in the drawing. Each tool half 33 is provided with a ramp 34 which biases the beam 5 into an opening 35 defined by the corresponding halves 33 of the support members 32. The physical dimensions of the ramps 34 and their geometrical positions define the relative position of adjacent openings 35. Each half 33 of each support member 32 has an actuator provided in this particular embodiment by an axially adjustable shaft 36. It will of course be appreciated that the tool halves 33 may be mounted on rollers and/or located in channels to provide direction for their motion. It will also be appreciated that the actuators may be mechanical, electrical, pneumatic, hydraulic or manual or any combination of these actuators. In addition to ramps 34 of different dimensions it is also possible to use a standard size ramp. The ramp may be raised or lowered through channels in a base (not shown) of the apparatus 31 in order to alter the vertical distance the openings 35 are located above the base.

In use, a beam 5 is passed between separable tool halves 33 to a predetermined position. The halves 33 are actuated by shafts 36 towards their corresponding halves 33 on the other side of the beam 5. The ramps 34 first engage the underside of the beam 5 and bias said beam 5 upwards towards the openings 35 defined by the support members 32. Corresponding ramps 34 are designed to pass side by side or may be formed one to receive the other.

Figure 4:
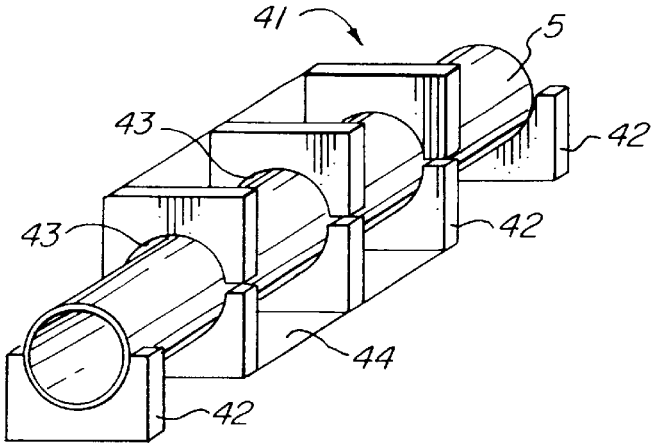
FIG. 4 is a perspective view of a second embodiment of support member.

Referring to the drawings and now to FIG. 4 there is shown a second embodiment of support member indicated generally by the reference numeral 41 for use with the actuation means of FIG. 1 or FIG. 2. Each support member 41 is provided by a pair of separable tool halves 42 which define an opening 43. In this embodiment, the three central support members 41 are mounted on one connecting plate 44. Each separate tool half 42 and the connecting plate 44 is mounted on a corresponding shaft (not shown) which provides movement for the tool halves 42 and the beam 5. This embodiment is particularly useful where a large volume of a beam with a standard shape is required.

Figure 5:
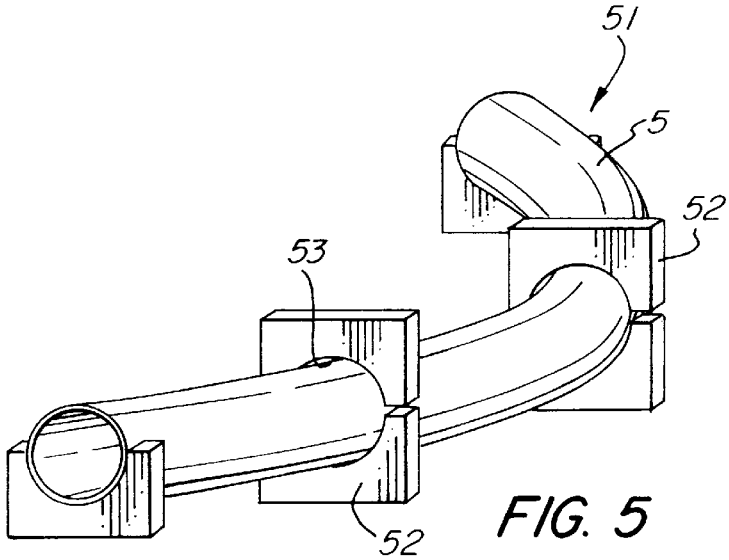
FIG. 5 is a perspective view of a third embodiment of support member.

Referring to FIG. 5, there is shown another embodiment of support member indicated generally by the reference numeral 51 for use with the actuation means of FIG. 1 or FIG. 2. In this embodiment, the cylindrical beam 5 and the tool halves 52 defining cylindrical openings 53 are formed for independent adjustment by corresponding shafts.

Figure 6:
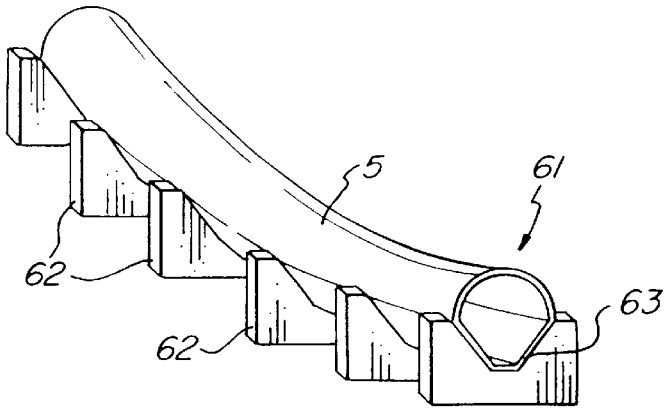
FIG. 6 is a perspective view of a fourth embodiment of support member.

Referring to the drawings and finally to FIG. 6, there is shown another embodiment of support member indicated generally by reference numeral 61 where the separable tool halves 62 (only one half of each pair of halves shown) define openings 63 which locally form the cross-sectional shape of the beam 5.

It will of course be understood that the invention is not limited to the specific details as herein described, which are given by way of example only, and that various alterations and modifications may be made without departing from the scope of the invention as defined in the appended claims.

What is claimed is:

1. A method of forming three-dimensional beams comprising the steps of:

(a) providing a plurality of support members;

(b) preheating a beam to a predetermined temperature suitable for subsequent forming and quenching steps;

(c) supporting the beam on the plurality of support members, the beam is non-cylindrical and has a longitudinal axis;

(d) locally engaging the beam by closing the support members thereon;

(e) forming the beam by repositioning at least one of the plurality of support members, the forming step includes twisting of the beam about the longitudinal axis and laterally positioning the support members relative to the longitudinal axis of the beam; and (f) quenching the thus formed beam.

2. A method as claimed in claim 1, wherein the forming step includes forming the beam into a desired overall form by adjustment of the support members by actuation means.

3. A method as claimed in claim 1, further including the step of preforming the beam by any suitable manufacturing process.

4. A method as claimed in claim 3, wherein any suitable manufacturing process is chosen from the group consisting of roll forming and blow molding.

5. A method as claimed in claim 1, wherein the forming step is carried out at one workstation.

* * * * *

UNITED STATES PATENT AND TRADEMARK OFFICE

CERTIFICATE OF CORRECTION

PATENT NO. : 6,751,998 B2
DATED : June 22, 2004
INVENTOR(S) : Anders Sundgren et al.

It is certified that error appears in the above-identified patent and that said Letters Patent is hereby corrected as shown below:

Column 2,
Line 54, "preformed" should be -- pre-formed --.

Column 4,
Line 67, after "thereon", -- by axially adjusting the support member on respective shafts -- should be inserted.

Column 5,
Line 5, after "beam", -- by laterally moving the shafts of the support members -- should be inserted.

Signed and Sealed this

Seventh Day of September, 2004

JON W. DUDAS
*Director of the United States Patent and Trademark Office*